US009199503B1

(12) United States Patent
Fisher et al.

(10) Patent No.: US 9,199,503 B1
(45) Date of Patent: Dec. 1, 2015

(54) LINERLESS THERMALLY-RESPONSIVE RECORD MATERIAL

(71) Applicant: APPVION, INC., Appleton, WI (US)

(72) Inventors: Mark Robert Fisher, Appleton, WI (US); Yves Defrenne, Appleton, WI (US)

(73) Assignee: APPVION, INC., Appleton, WI (US)

( * ) Notice: Subject to any disclaimer, the term of this patent is extended or adjusted under 35 U.S.C. 154(b) by 0 days.

(21) Appl. No.: 14/316,107

(22) Filed: Jun. 26, 2014

(51) Int. Cl.

| | |
|---|---|
| ***B41M 5/42*** | (2006.01) |
| ***B41M 5/44*** | (2006.01) |
| ***B41M 5/327*** | (2006.01) |
| ***B41M 5/337*** | (2006.01) |
| ***B41M 5/333*** | (2006.01) |
| *G09F 3/02* | (2006.01) |

(52) U.S. Cl.
CPC ..... *B41M 5/443* (2013.01); *B41M 5/3275* (2013.01); *B41M 5/3336* (2013.01); *B41M 5/3372* (2013.01); *B41M 5/426* (2013.01); *B41M 2205/40* (2013.01); *G09F 2003/0211* (2013.01)

(58) Field of Classification Search
CPC ..... B41M 5/426; B41M 5/44; B41M 5/443; B41M 2205/04; B41M 2205/34; B41M 2205/36; B41M 2205/38; B41M 2205/40; B41M 5/42; G09F 2003/0211
USPC ..... 503/200–226; 427/152
See application file for complete search history.

(56) References Cited

U.S. PATENT DOCUMENTS 6,352,768 B1 * 3/2002 Hseih et al. ..... 428/352

* cited by examiner

*Primary Examiner* — Bruce H Hess
(74) *Attorney, Agent, or Firm* — Muncy, Geissler, Olds & Lowe, P.C.

(57) ABSTRACT

The invention describes a composition and method of providing an improved thermally responsive record material useful for linerless labels. The record material comprises a support having provided thereon on one surface an adhesive material, and on at least one other surface, a heat sensitive imaging coating. The method comprises applying to a first surface a first layer of a coating of a heat sensitive color-forming composition comprising a binder material and a substantially colorless dye precursor and an acidic developer material in substantially contiguous relationship. Over the first layer is applied a release coat overcoating the first layer. The release coat comprises a water soluble or water dispersible polymeric material, a polysiloxane release agent and excess platinum catalyst in excess of 150 ppm based on weight of the second coating. The release coat is cured at a temperature of from at or below 160° C., or even from 70° to 120° C. to a scuff resistant hardness and without visible background discoloration of the first layer.

19 Claims, No Drawings

LINERLESS THERMALLY-RESPONSIVE RECORD MATERIAL

BACKGROUND OF THE INVENTION

1. Field of the Invention

This invention relates to a thermally-responsive record material. It more particularly relates to such record material in the form of sheets coated with color-forming systems comprising chromogenic material (electron-donating dye precursors) and acidic color developer material.

This invention particularly relates to thermally responsive record material in the form of linerless thermally imaging labels with an adhesive which can be permanent, semi-permanent or repositionable. The thermally responsive record material of the invention does not require a liner material and is useful for point of sale imaging.

This invention particularly concerns a thermally-responsive record material capable of forming a substantially non-reversible image and useful for producing functional bar codes, text, images or other indicia. The invention teaches compositions and methods for forming improved thermally-sensitive record materials which can be imaged without printhead debris, background discoloration, surface scuffing of the record material, dusting and other image defects.

2. Description of the Related Art

Thermally-responsive record material systems are well known in the art and are described in many patents, for example. U.S. Pat. Nos. 3,539,375; 3,674,535; 3,746,675; 4,151,748; 4,181,771; 4,246,318; and 4,470,057 which are incorporated herein by reference. In these systems, basic colorless or lightly colored chromogenic material and acidic color developer material are contained in a coating on a substrate which, when heated to a suitable temperature, melts or softens to permit the color-forming materials to react, thereby producing a colored mark.

Thermally-responsive record materials have characteristic thermal response, desirably producing a colored image of sufficient intensity upon selective thermal exposure.

Thermally-responsive record materials are increasingly utilized for labels for recording variable information such as text, bar code imaging, graphics, alphanumeric characters and the like since such labels can be readily created by printer equipment in the field nearer the point of use and application.

Bar codes provide a convenient means for computerized inventory or goods handling and tracking. To function properly, it is necessary that the bar code have high print contrast signal, and that the thermally-responsive material on which the bar code is imaged resist unwanted bar width growth after imaging. The characters or bars must not only be intensely imaged, but must be sharp, and unbroken or free of pin holes. It is also necessary that when read by a scanner that a high percentage of scans result in successful decoding of the information in the bar code. The percentage of successful decodes of the bar code information must be maintained at a high value for the thermally-responsive record material to gain wide commercial acceptance for use in bar coding applications.

Print contrast signal relates to image intensity. Bar width growth relates to imaged bar dimensional stability and character sharpness. Percent decode relates to image integrity. Background contrast must also be maintained at a high level.

Use of recording sheets in the form of adhesive labels has grown, as interest in printing or imaging point of sole information has grown. Conventional labels typically have an adhesive on one surface for affixing, permanently or removably, the label onto another surface, object or package depending on the end use.

To improve resource conservation, interest has grown in linerless labels which can eliminate a liner material often employed with tacky or pressure sensitive adhesives which protect the adhesive layer prior to the label application.

Keeton (U.S. 2009/0169282) describes a heat activated linerless label where one or more printheads can selectively heat activate specific adhesive portions of a label. A subcoat isolation layer is taught to avoid adverse interaction between chemicals and/or impurities of the paper with the thermally sensitive coating. Additionally, a top coat is taught optionally applied over the thermally-sensitive coating.

Matsubayashi et al., 2007/0092665 references Japanese Patent Application Second Publication No. Hei 4-15110 as describing a heat sensitive recording adhesive label with a release agent layer on the surface of a heat sensitive recording sheet which also relies on a blocking layer. Hei 4-15110 describes a heat sensitive color-developing sheet on which a polyvinylalcohol blocking or protective undercoat layer is first applied. Over the blocking layer, or isolation layer, a solventless ultraviolet curing silicone of organopolysiloxanes with mercapto and vinyl groups along with acetophenone curing initiator is applied, followed by ultraviolet irradiation to form a release agent. An adhesive such as an acrylic emulsion adhesive is coated on the undercoat isolation or blocking layer on the opposite surface.

It would be an advance in the art if the need for an isolation, insulating, or blocking layer could be eliminated without interfering background discoloration of the heat sensitive recording sheet or other adverse interaction. Often the constituents of conventional heat sensitive release coats, especially curable release coats, for recording sheets adversely affect the heat sensitive layer interfering with image formation or resulting in a light or faded coloration of the image or background or in some cases no image at all. A need exists for such a heat sensitive recording sheet especially a heat sensitive linerless label that does not need a blocking, isolating or blocking layer and that is substantially free of dust residues that could affect printhead and image quality, and which does not suffer from layer lift off, abrading or scuffing, yet produces a high contrast, high intensity image useful for imaging and/or bar coding for point of sale applications.

SUMMARY OF THE INVENTION

The present invention teaches an improved thermally responsive record material useful for linerless labels, the record material comprising a substrate having first and second surfaces and having provided thereon on at least a first surface. On a surface is provided a heat sensitive coating comprising in one or more layers a substantially colorless dye precursor and an acidic developer material in substantially contiguous relationship. In addition, a release coating is applied over the heat sensitive coating and in direct contact with the heat sensitive coating. The release coating comprises an aqueous mixture of a water soluble or water dispersible polymeric material, a release agent, preferably polysiloxane, and an excess of platinum catalyst in excess of 150 ppm; and, a binder material. The heat sensitive coating upon being heated reacts with the dye precursor to develop color. The release coating is cured at a temperature of 160° C. or less, or even from 70° C. to 120° C. without visible background discoloration of the heat sensitive coating and to a scuff resistant hardness.

The present invention also teaches a method of providing an improved thermally responsive record material useful for linerless labels. The record material comprises a support having provided thereon on one surface an adhesive material, and on at least one other surface, a heat sensitive imaging coating. The method comprises applying to a first surface a first layer of a coating of a heat sensitive color-forming composition comprising a binder material and a substantially colorless dye precursor and an acidic developer material in substantially contiguous relationship. Applied over the first layer, a second layer is overcoated over the first layer and in direct contact with the heat sensitive coating. The second layer comprises a water soluble or water dispersible polymeric material, a release agent and platinum catalyst in excess of 150 ppm. The second layer is at a temperature of 160° C. or less, or even from 70° C. to 120° C. without visible background discoloration of the first layer.

DESCRIPTION OF THE INVENTION

The invention describes a composition and method of providing an improved thermally responsive record material useful for linerless labels. The record material comprises a support having provided thereon on one surface an adhesive material, and on at least one other surface, a heat sensitive imaging coating. The method comprises applying to a first surface a first layer of a coating of a heat sensitive color-forming composition comprising a binder material and a substantially colorless dye precursor and an acidic developer material in substantially contiguous relationship.

Over the first layer is applied a second layer overcoating the first layer and in direct contact with the heat sensitive coating. The second layer comprises a water soluble or water dispersible polymeric material, a release agent and platinum catalyst in excess of 150 ppm based on weight of the second layer by weight of coating. The second layer is cured at a temperature at or below 120° C., in alternate embodiments or even below 160° C., or even from 70° to 120° Centigrade (C.) or even to 160° C. without visible background discoloration of the first layer.

In a further embodiment the invention teaches an improved thermally responsive record material useful for linerless labels. The record material comprises a support having provided thereon a coating of a heat sensitive coating comprising a binder material and a first layer of a substantially colorless dye precursor and an acidic developer material in substantially contiguous relationship. Included in addition is a second layer overcoating the first layer and in direct contact with the heat sensitive coating. The second layer comprises a water soluble or water dispersible polymeric material, a release agent and excess platinum catalyst in excess of 150 ppm based on weight of the second layer. The first layer upon being heated reacts with the dye precursor to develop color. The second layer cures at temperature of from 70° to 120° C. or even to 160° C. without visible background discoloration of the first layer.

Surprisingly, the invention teaches an aqueous based release coating applied directly onto a thermally imaging coating useful for forming linerless thermally imaging record materials such as linerless labels.

In the invention, surprisingly, the level of platinum catalyst is used in excess in the polymeric release coating. Curing is able to be effected without giving rise to background discoloration.

The platinum catalyst can have an oxidation state from 0 to IV. Exemplary platinum catalysts include chloroplatinic acid and olefin complexes, platinum (0) complexes containing vinyl-siloxane ligands, platinum (II) chloride, salts of chloroplatinic acid, tetrachloroplatinic acid, platinum (IV) chloride, hexachloroplatinic acid, hexachloroplatinic acid ammonium salt, platinum (II) oxide, platinum (II) hydroxide, platinum (IV) dioxide, platinum (IV) oxide, platinum (IV) disulfide, platinum (IV) sulfide, potassium hexachloroplatinate (IV), dichloro(cycloocta-1,5-diene) platinum (II), ammonium salts of chloroplatinic acid, etc. Exemplary platinum catalysts include commercially available catalysts such as Catalyst 454E (Wacker Chemical Corporation, Adrian, Mich.), Cat-PM-10A Shin-Etsu Chemical (Tokyo, Japan).

Several unexpected benefits arise from the increased platinum loadings. Surprisingly premature imaging of the thermally imaging layer is prevented by accelerated cure rates of the release layer. Moreover, the increased platinum loadings, although shortening pot life, have the benefit of enabling a sufficient level of cure of the release coat below about 160° C. or even below about 120° C., or from 80° C. to 150° C. or even from 70° C. to 100° C., or even from 70° C. to 120° C. or even 70° C. to 85° C.

The present invention provides an improved record material useful for linerless label applications. The record material of the invention is based on an aqueous addition coating that can be applied in direct contact to the thermally imaging layer. The aqueous emulsion functions as a release coat and can be applied in direct contact with the thermally imaging or heat sensitive layer. Present day solventless and UV coatings cannot typically be applied in direct contact with the heat sensitive imaging layer, requiring instead some type of protecting or sealing or blocking layer.

Aqueous coatings, through facilitating ease of application, customarily required high temperature and long dwell times to cure the coating. Such requirements add challenges in manufacture of thermally imaging systems where high temperatures and extended dwell times lead to premature discoloration of the heat sensitive imaging coating.

The various constituents of the heat sensitive imaging coating are preferably selected to result in an activation temperature that is above the cure temperature of the release coating. Preferably the activation temperature of the heat sensitive imaging coating is at least 5° C. higher or even at least 10° higher or even at least 15° C. higher than the cure conditions of the release coating. With a separation in activation versus cure temperatures, robust whiteness of the sheet is preserved by minimization and even elimination of background discoloration.

The resultant product is highly sensitive by virtue of the fact that the release coating is in direct contact with the heat sensitive imaging layer facilitating rapid heat transference.

Linerless construction typically requires a separator layer or prime coat or isolation layer or blocking layer. Such an additional layer reduces heat transfer and sensitivity of the thermally imaging layer or heat sensitive imaging coating.

It is also desirable to increase scuff resistance. Traditional release coats based on silicone are known to rapidly build up dust of loose silicone and other materials under the printhead leading to poor image quality, equipment malfunction, or need for regular cleaning and maintenance. Buildup ultimately can lead to spacing from the imaging media and poor heat transfer. The poor heat transfer manifests itself as poorly imaged bands and in extreme cases areas with no visible image. These problems have limited the acceptability of linerless thermally imaging label products in demanding applications such as bar coding where poor imaging qualities translate to scanner misreads or unreadable labels.

The invention overcomes many of these problems by teaching a release coat composition and method of application achieving a high level of cure of achieving a high level of mechanical and/or chemical bonding with the active coat or thermally imaging coating. This minimizes dusting, increases sensitivity and leads to a higher quality image capability.

The adhesive layer can include any of various types of known adhesives, preferably aqueous or latex based, and may be applied wet, allowed to dry, and then heat-activated to become tacky. As examples, some common types of adhesives that could be used include water based acrylics. In the water based acrylics, water is a carrier that dries to leave the adhesive resin. Among other adhesives, the adhesives can for example include acrylate polymers with a glass transition temperature Tg>50° C. in combination with amorphous polyurethane or polyurethane-polyurea polymers with a glass transition temperature Tg<+10° C. such as taught in US Publication 20130143010, incorporated herein by reference. In alternative embodiments, adhesives can be applied in a heat softened form and then cooled, potentially to a solid. Water based adhesives are preferred.

The adhesive layer can comprises in addition a plasticizer and tackifier. With certain adhesives, physical states of an adhesive material can be controlled between solid and non-solid by altering temperature. The open time of an adhesive can be controlled by adjusting a ratio of the components, including the adhesive monomers, the plasticizer, and tackifier. The preferred activation temperature for the adhesive layer is preferably within the range of from about 50° C. to about 120° C. However, it will be understood that the invention is not limited to adhesive systems exhibiting activation temperatures within this range. Adhesive systems of this type are described in detail in US Publication 20130133532, incorporated herein by reference.

With an activatable linerless label adhesive, the properties of adhesion and viscosity change at an activation temperature. Therefore, a pressure sensitive adhesive system can be thermally switched to a more tacky state. If such adhesive system is coated on the surface of a substrate at a temperature below the designed switch temperature, the adhesive material can be in its non-sticky solid state. This permits a label construction of a substrate which can be wound in a roll form, and useful for a linerless application. During use, such as applying a label substrate to a surface, the temperature is increased so that the adhesive material changes to a non-solid state and then exhibit its pressure sensitive adhesive properties, which allows an activatable linerless label to be adhered to a substrate as desired as a result of increased adhesion properties The adhesive can be selected by way of illustration and without limitation from one or more lower alkyl acrylates, styrene, methyl methacrylate, methacrylic acid, acrylic acid, one or more multifunctional monomers, and one or more chain transfer agents. The invention is not intended restricted to any one adhesive formulation. A wide array of alkyl acrylates can be used singly or in combination to form the adhesive. For example, methyl acrylate, butyl acrylate, ethyl acrylate, and 2-ethylhexyl acrylate could be used. A wide array of styrene and styrene based materials can also be used in combination. However, it will be appreciated that other analogues and functionally equivalent monomers could be used, and that various adhesives are known in the art for linerless applications.

An alternative adhesive layer can comprise various pressure sensitive and microencapsulated adhesives such as taught in Schwantes, et al., U.S. Pat. No. 8,119,214. With an encapsulated adhesive layer, the capsules are typically applied to a substrate in a binder system that is non-tacky and dry to the touch. The system can also be curable. In this way, otherwise tacky or liquid flowable adhesives can be pre-applied, but not activated or bond forming until the capsule walls themselves are fractured releasing or exposing the adhesive materials. For example, Eichel (U.S. Pat. No. 2,986,477) teaches the encapsulation of tacky adhesive materials. Wallace (U.S. Pat. No. 4,428,982) teaches the encapsulation of curable anaerobic adhesives wherein the encapsulated curable adhesive remains in a liquid or uncured state in the capsule until use. Schwantes (U.S. Pat. No. 6,592,990) teaches encapsulated adhesives, particularly pressure sensitive adhesives, wherein the adhesive is formed in-situ, after encapsulation of the ingredients therefore.

A wide array of monomers or multifunctional monomers can be used for the adhesive layer of the present invention. Multifunctional monomers can also be used to achieve cross-linking of the adhesive monomers. Representative examples of such multifunctional monomers include, but are not limited to, difunctional monomers, trifunctional monomers, and multifunctional monomers having more than three active functional sites. Useful examples of difunctional monomers include, but are not limited to 1,4-butanediol diacrylate, polyethylene glycol diacrylate, and combinations thereof. Another preferred difunctional monomer is ethylene glycol dimethacrylate. Trifunctional monomers include, but are not limited to ethoxylated trimethylolpropane triacrylate, propoxylated glycerol triacrylate, and combinations thereof. Preferred examples of multifunctional monomers having more than three active functional sites include, but are not limited to, ethoxylated pentaerythritol tetraacrylate, and combinations thereof. These and numerous other suitable multifunctional monomers are commercially available from various suppliers such as Sartomer Company, Inc. of Exton, Pa.

Optionally, the adhesive layer can comprise chain transfer agents to form activatable adhesives These are typically used at concentrations of from about 0 to about 5.0%, and preferably from about 1.0% to about 4.0% (percentages are based upon the total weight of monomer and chain transfer agent). Representative examples of suitable chain transfer agents include, but are not limited to n-dodecyl mercaptan, tert-nonyl mercaptan, isooctyl 3-mercaptopropionate, and combinations thereof. Suitable chain transfer agents are available commercially such as from Sigma Aldrich of St. Louis, Mo. The adhesive for example can comprise one or more monomers and one or more chain transfer agents.

Methods of applying adhesives include flood coating an entire surface of a substrate or selectively coating an area of the surface. Alternatively, the adhesives could comprise a dry film that is heat-activated to become tacky. The dry film may be applied to a surface of the substrate as a wet adhesive. An example of a wet adhesive is a water based acrylic adhesive. Methods of applying the dry film include covering an entire surface of a substrate with the dry film or selectively covering an area of the surface. Optionally, a heat seal layer can be included between the adhesive layers and the substrate. The heat seal layer can include a clay coating or a variety of resins. A heat seal layer can prevent heat applied to one surface from being transferred to the opposing surface of the substrate.

The adhesives can be modified to provide varying degrees of "tack", i.e., stickiness or strength of adherence, for the labels. As examples, the tack of an adhesive can be varied by modifying the adhesive's chemical composition, shape, size, and thickness. With some types of adhesives, the strength of adherence varies with the amount of adhesive applied. The adhesive's tack also can be varied by selectively activating different patterns on the adhesive. The adhesives can for example include acrylate polymers with a glass transition temperature Tg>50° C. and amorphous polyurethane or polyurethane-polyurea polymers with a glass transition temperature Tg<+10° C. such as taught in US Publication 20130143010, incorporated herein by reference.

The release coating can include a heat curable silicone release agent or a polysiloxane release agent. Materials of this type are available commercially such as Silforce silicone emulsions (Momentive Performance Materials, Albany, N.Y.) or Silcolease silicone emulsions (Bluestar Silicones, East Brunswick, N.J.). The release agent can include a UV or heat curable release agent comprising silicone or polysiloxane. Griswold et al., U.S. Pat. No. 6,077,611 incorporate by reference, describes aqueous silicone release emulsions useful as a release agent for forming the release coating of the invention. These comprise condensation curable and addition curable silicone emulsions with a polymeric material such as an aqueous polyurethane emulsion. These types of release coats can be cured to a linerless release coating. The release agent can comprise polysiloxane polymer such as an alkenyl substituted polysiloxane, and a hydride functional cross-linking silicone such as a methyl hydrogen siloxane polymer, or methyl hydrogen polysiloxane, silanol stopped polysiloxane, and various organosiloxanes.

The polymeric material of the release coating can comprise among other polymers, and by way of illustration and not limitation, polyurethanes, reaction products of polyisocyanates, polydiisocyanates, polyisocyanurates, cycloaliphatic polyisocyantes, aromatic polyisocynates, with various polyols and polyether polyols. Exemplary polymeric material of the release coating can include reaction products of various polyisocyanates or isocyanurates with various polyols or polyether polyols. For example the polyisocynates can comprise polyisocyanate having at least two isocyanate (—NCO) functionalities per molecule, such as diisocyanate monomers or oligomers, aliphatic polyisocyanates such as 1,6-hexamethylene diisocyanate, and isocyanurate-containing derivatives; cycloaliphatic polyisocyanates such as 4,4'-mthylene bis(cyclohexyl isocyanate), cyclohexane 1,4-diisocyanate and isocyanurate derivatives; aromatic polyisocyanates such as 4,4'-diphenylmethane diisocyanate, xylyene diisocyanate, toluene diisocyanate, isophorone diisocyanate, 1,5-naphthalene diisocyanate, 4,4',4"-triphenylmethane diisocyanate, and its isocyanurate-containing derivatives. Mixtures or the reaction products of polyisocyanates can be used. Polyisocyanates containing the reaction products of diisocyanate including isocyanurate, urea, allophanate, biuret, carbodiimide, and uretonimine entities can also be used. The foregoing can be reacted with various polyols such as polyols having at least two hydroxy functionalities per molecule and a molecular weight ranging from 250 to 5000 g/mole. The polyol may be selected from those commonly found in polyurethane manufacturing. They include hydroxy-containing or terminated polyesters, polyethers, polycarbonates, polythioethers, polyolefins, and polyesteramides. Suitable polyester polyols include hydroxy-terminated reaction products of ethylene glycol, propylene glycol, diethylene glycol, neopentyl glycol, 1,4-butanediol, furan dimethanol, polyether diols, or mixtures thereof, with dicarboxylic acids or their ester-forming derivatives. Polyesters obtained by the polymerization of lactones, such as caprolactone may also be used.

Polyether polyols useful for the polyurethane reaction for the polymeric material of the release coating include products obtained by the polymerization of a cyclic oxide including ethylene oxide, propylene oxide or tetrahydrofuran, or mixtures thereof. Polyether polyols include polyoxypropylene, polyols, polyoxyethylene, polyols, poly(oxyethylene-co-oxypropylene) polyols, polyoxytetramethylene, polyols.

Polycarbonate polyols useful for the polyurethane reaction for the polymeric material of the release coating include reaction products obtained by reacting diols such as 1,3-propanediol, 1,4-butanediol, 1,5-pentanediol, 1,6-hexanediol, diethylene glycol with diaryl carbonates such as diphenyl carbonate, or with phosgene, or with aliphatic carbonate, or with cycloaliphatic carbonate. Commercial polycarbonate diols include Duracarb 120 series aliphatic diols and Durocarb 140 series cylco aliphatic diols, both of PPG Industries.

The record material according to the invention has a non-reversible image in that it is non-reversible under the action of heat. The coating of the record material of the invention is basically a dewatered solid at ambient temperature.

The color-forming system of the record material of this invention comprises the electron donating dye precursors, also known as chromogenic material, in its substantially colorless state together with an acidic developer material. The color-forming system relies upon melting, softening, or subliming one or more of the components to achieve reactive, color-producing contact with the chromogen. Substantially colorless for purposes of the invention is understood to mean colorless or lightly or faintly colored.

The invention is functional with various fluorans and leuco dye precursors, including 2-anilino-3-methyl-6-dibutylaminofluoran, including the various crystalline or recrystallized forms such as .alpha. or .beta.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimension and a comparative small thickness dimension. The substrate or support material can be opaque, transparent or translucent and could, itself, be colored or not. The material can be fibrous including, for example, preferably paper and filamentous synthetic materials and combinations with papers and films. It can also be a film including, for example, cellophane and synthetic polymeric sheets cast, extruded, or otherwise formed. Neutral sized base paper has been used in thermally-imaged record systems for 25 years and is a preferred substrate. However, various kinds and types of substrates, and combinations can be selected in various embodiments.

The components of the heat sensitive coating are in substantially contiguous relationship, substantially homogeneously distributed throughout the coated layer or layers deposited on the substrate. For purposes of this invention the term substantially contiguous is understood to mean that the color-forming components are positioned in sufficient proximity such that upon melting, softening or subliming one or more of the components, a reactive color-forming contact between the components is achieved. As is readily apparent to the person of ordinary skill in this art, these reactive components can be in one layer or can be positioned in separate layers using multiple layers. In other words, one component, such as colorformer, can be positioned in a first layer, and coreactive or modifier components positioned in a subsequent layer or layers. All such arrangements are understood herein as being substantially contiguous, and intended as included in the term heat sensitive coating.

The acidic developer to dye precursor ratio by weight is preferably maintained at from 1:1 to about 2:1. The modifier to dye precursor ratio by weight is preferably maintained at from 0.3:1, to about 1:1, or even greater than 1:1.

In manufacturing the record material, a coating composition is prepared which includes a fine dispersion of the components of the color-forming system, and binder material, preferably polymeric binder such as polyvinyl alcohol.

The heat-sensitive coating composition can additionally contain pigments, such as clay, talc, silicon dioxide, aluminum hydroxide, calcined kaolin clay and calcium carbonate, and urea-formaldehyde resin pigments at from 0 to 30%, or even 0 to 15% by weight of the heat-sensitive coating. Other optional materials include natural waxes, Carnauba wax, synthetic waxes, lubricants such as zinc stearate; wetting agents; defoamers, other modifiers and anti-oxidants. The modifier typically does not impart any image on its own but as a relatively low melt point solid, acts as a solvent to facilitate reaction between the mark-forming components of the color-forming system. Optionally though not preferred in the invention due to interference with heat transfer as described above, the thermally-sensitive record material can be top coated with a polymeric coating such as polyvinyl alcohol.

The color-forming system components are substantially insoluble in the dispersion vehicle (preferably water) and are ground to an individual average particle size of less than 10 microns, preferably less than 3 microns or smaller. The polymeric binder material is substantially vehicle soluble although latexes are also eligible in some instances. Preferred water soluble binders, which can also be used as topcoats, include polyvinyl alcohol, hydroxyl ethylcellulose, methylcellulose, methyl-hydroxypropylcellulose, starch, modified starches, gelatin and the like. Eligible latex materials include polyacrylates, styrene-butadiene, rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 0.1 to about 9 grams per square meter (gsm), or even from 1 to about 9 gsm, or even from 3 to about 9 gsm and preferably about 5 to 6 gsm. The practical amount of color-forming materials is controlled by economic considerations, functional parameters and desired handling characteristics of the coated sheets.

Electron-donating dye precursors or chromogens include chromogenic compounds such as the phthalide, leucoauramine and fluoran compounds. These chromogenic materials or electron donating dye precursors are well known color-forming compounds for use in color-forming record systems. Examples of the compounds include Crystal Violet Lactone (3,3-bis(4-dimethylaminophenyl)-6-dimethylaminophthalide), (U.S. Pat. No. RE 23,024); phenyl-, indolyl, pyrrolyl, and carbazolyl-substituted phthalides (for example, in U.S. Pat. Nos. 3,491,111; 3,491,112; 3,491,116; 3,509,174); nitro-, amino-, amido-, sulfonamide-, aminobenzylidene-, halo-, aniline-substituted fluorans (for example, the U.S. Pat. Nos. 3,624,107; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way are: 3-diethylamino-6-methyl-7-anilino-flouran (U.S. Pat. No. 4,510,513); 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3, 5'6-tris (dimethylamino)spiro[9H-fluorene-9,1'(3'H)-isobenzofuran]-3'-one; 7-(1-ethyl-2-methylidole-3-yl)-7-(4-diethylamino-2-ethoxyphenyl)-5,7-dihydrofuro[3,4-b] pyridine-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindole-3-yl)-7-(4-diethylamino-2-ethoxyphenyl)-5,7-dihydrofuro]3,4-b]pyridine-5-one; 3-diethylamino-7,8-benzofluoran; 3,3-bis(1-ethyl-2-methylidole-3-yl)phthalide; 3-diethylamino-7-enilinofluoran; 3-diethylamino-7-benzylaminofluoran; 3'-phenyl-7-dibenzylamino-2,2'-spirodi-[2H-1-benzopyran] and mixtures of any of the following.

The developer is preferably bis(4-hydroxy-3-allylphenyl) sulphone.

Other known developer materials may also be included provided not used in an amount so as to detract from the functionality of the combination of the invention. Other acidic developer materials include the compounds listed in U.S. Pat. No. 3,539,375 as phenolic reactive material, particularly the monophenols and diphenols. Acidic developer materials also include, the following compounds: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salcyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl)pentanoate; methyl-4,4-bis(4-hydroxyphenyl) pentanoate; alkyl-4,4-bis(4-hydroxyphenyl) pentanoate; 3,3-bis(4-hydroxyphenyl)(-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; and benzyl-p-hydroxybenzoate.

Examples of other developer compounds include phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, aftapulgite, hallosyte, and the like. Some of the polymers and minerals do not melt but undergo color reaction on fusion of the chromogen.

Optionally, modifiers can also be included. These modifiers for example, can include acetoacetyl-o-toluidide, phenyl-1-hydroxy-2-maphthoate, 1,2-diphenoxyethane, and p-benzylbiphenyl. Optionally, though not preferred, the record material can be topcoated or use subcoats such as insulating layers or hollow spheres. The color-forming system components are substantially insoluble in the dispersion vehicle (preferably water) and are ground to an individual average particle size of between about 1 micron to about 10 microns, preferably about 1-3 microns or less. The polymeric binder material is substantially vehicle soluble although latexes are also eligible in some instances. Preferred water soluble binders include polyvinyl alcohol, hydroxyethylcellulose, methylcellulose, methyl(hydroxypropyl) cellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection in an amount less than will interfere with achieving reactive contact between color-forming reactive materials.

If desired, submicron, nano-like particulates and suspension of the components of the invention can be employed and manufactured through several techniques. One technique can involve crystal precipitation. In this technique crystals are grown dissolved in solvent. A non-solvent is added to course precipitation or crystallization. Alternative techniques rely on milling or wet milling to achieve submicron particles. With these techniques the crystals are intentionally fractured and comminuted to particles smaller than the crystal size of initial formation, which varies from material to material. As sizes decrease, various effects not seen with larger particulates are expressed, most notability more intense image density.

Small particulates can be produced by aerosol methods, or chemical mechanical grinding. This may entail a ball mill, rod mill, SAG mill, autogenous mill, pebble mill or other means of grinding or comminuting to submicron sizes. In some embodiments the material may be subjected to one or more heating steps during grinding. It is contemplated that grinding or comminuting can be conducted under ambient conditions, under an inert gas, or at elevated temperature or even in the presence of a liquid chemical agent to facilitate small particle formation. The optional liquid medium can include a solvent, surfactant, or lubricant.

Formation of nano type or nano-like particles can involve physical and chemical methods. Physical methods include, for example, electrospray, ultrasound, spray drying, superior fluid, solvent/anti-solvent crystallization and cryogenic technology. Electrospraying is disclosed in U.S. Pat. No. 3,208,951; ultrasound techniques are disclosed in U.S. Pat. No. 5,389,379 and supercritical carbon dioxide methods are disclosed in U.S. Pat. No. 5,639,441, U.S. Pat. No. 6,095,134 and U.S. Pat. No. 6,630,121; spray drying using compressed air is disclosed in U.S. Pat. No. 6,582,285 and U.S. Pat. No. 6,431,478. In addition, emulsion polymerization, interface polymerization and coagulation/phase separation can be used to fabricate nanoparticles. The above patents are incorporated herein to the extent that they provide exemplary, procedural or other details supplementary to those set forth herein.

All patents, test procedures, and other documents cited herein, including priority documents, are fully incorporated by reference to the extent such disclosure is not inconsistent with this invention and for all jurisdictions in which such incorporation is permitted.

The thermally-responsive sheets were made by making a coating dispersion. The dispersion was applied to a support with a wire wound rod and dried. Other materials such as fillers, antioxidants, lubricants and waxes can be added to the dispersion if desired. The sheets may be calendered to improve smoothness.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component can be prepared by milling the component in an aqueous solution of the binder until a particle size of less than 10 microns is achieved. The milling was accomplished in an attritor or other suitable milling device. The desired average particle size was less than 3 microns in each dispersion.

The thermally-responsive sheets were made by making separate dispersions of chromogenic material, modifier material, and developer material. The dispersions are mixed in the desired ratios and applied to a support with a wire wound rod and dried. Other materials such as fillers, antioxidants, lubricants and waxes can be added if desired. The sheets may be calendered to improve smoothness.

The thermal performance of the sheet can be measured by imaging the sheet on a dynamic thermal tester, such as an Atlantek Thermal Response Tester, Model 200. The thermal testing unit images the sheet with a constant cycle time, and a sequentially increasing dot pulse duration resulting in a series of thermal images of increasing intensity. The thermal images can be measured using a MacBeth RD-922 densitometer. The densitometer is calibrated such that 0.05 indicates pure white and 1.79 a fully saturated black image.

A MacBeth densitometer can be used to measure the properties of thermal recording material. In certain circumstances this instrument by itself may not capture all the necessary information needed to assess a thermal recording material. Such a test is useful for determining background. The following additional tests can also be informative: PCS (print contrast signal), BWG (bar width growth), % Decode (percentage of the scans which will result in a successful decoding of the information in the bar code), and the background (the relative darkness of the unimaged area). The invention exhibits excellent properties as a thermal recording material for producing functional images, including bar codes. The invention enables an improved thermally responsive record material in terms of PCS intensity, BWG, % Decode and whiteness of background.

A LaserCheck II scanner and verifier of Symbol Technologies conveniently can be used to measure print contrast signal, change in bar width growth, percent decode and background.

In certain applications, the use of a MacBeth densitometer measurement alone can be insufficient in ascertaining suitability of a thermal recording material, such as for bar code applications. The densitometer measures image density, but in a bar code application, a dense image could nonetheless be deficient. Characters or character edges may be fuzzy or indistinct. Pinholes could exist in otherwise dense solid areas and similar defects all can make an otherwise dense image unsuitable for bar code applications, despite a high MacBeth reading.

The addition of tests such as PCS, BWG and % Decode can provide a more accurate screening for suitability for bar code applications.

The following bar code related tests are conveniently measured with a LaserCheck II scanner and verifier. (Standardize LaserCheck II scanner and verifier unit to 0.90 PCS ratio.)

% Decode is a measure of the average probability that a single scan of a bar code would result in a successful decode or translation. In a well designed bar code system, that probability is desired to approach 100%.

PCS or print contrast signal is a measurement of the contrast or brightness difference between the bars and spaces of a bar code. A threshold PCS value is needed for a bar code to be scannable. PCS=(RL−RD)/RL; where RL is the reflectance of the background and RD is the reflectance of the dark bars.

BWG is the average deviation of bars from nominal widths over the entire symbol. The thickness of the bar is measured from the edge closest to the start character to the trailing edge of the same bar.

The following tests can be useful to assess a thermally imaging record material.

Test Methods

Test procedure: Samples are imaged on Hobart 18VP printer. Cut into individual samples with each sample bearing a complete bar code.

Water test: Imaged samples are placed into 100 ml beakers that contain distilled water. Each beaker is able to hold two samples. The bar codes should not contact each other. The bar code should be completely immersed. Restain samples in the water for 24 hours at room temperature. Then, remove from the water and allow to air dry for not less than four hours and not more than 24 hours. Read and record with LaserChek II scanner and bar code verifier. The PCS, BWG, % Decode and background are measured.

70° C. Cup Humidity Test: This method can be used for determining the physical resistance of samples to environmental humidity exposures at 70° C. The following materials are used in conducting this test: Hobart 18 VP printer or equivalent; LaserChek II scanner and verifier; test samples two 9/16" (CD.times.11" (MD)); 1000 ml beaker; 1000 ml beaker cover; oven maintained at 70° C.

Image bar code on samples using Hobart printer. Adjust voltage to 1.2 watts/dot. Cut strip into individual labels. Each label should have a complete bar code.

Imaged samples are secured inside of a 1000 ml beaker containing 250 ml of water. The labels should not be contacting the water directly. The lid is placed on the beaker and the beaker is placed in the 70° C. oven for 24 hours. The labels are removed from the beaker and allowed to air dry for not less than 1 hour or more than 24 hours. Read image with LaserCheck II scanner and verifier.

The PCS, PWG, % Decode and background are measured.

40° C./90% RH: cut two samples of the paper to be tested to 4½ CD.times.7"MD. Cut an approximate 1" diameter circle from center of sample. Place samples suspended apart in a 40° C.-90% relative humidity chamber. Maintain temperature and humidity at 40° C. (104° F.) dry bulb and 90% RH (100° F.) wet bulb. After exactly 48 hours, remove samples, and cool. Record original background and background after exposure. Calculate and record the percentage change in background decline using the following formula:

Original Background—Exposed Background Times 100
Original Background

The PCS, BWG, Decode and background are conveniently measured with a LaserChek II scanner and verifier of Symbol Technologies. A MacBeth densitometer can also be used for background measurement.

Wet PVC-Room Temperature. Four imaged labels are immersed in distilled water for five seconds. Immediately wrap the wet label in plastic film as described in the 40° C. PVC test. Place the wrapped labels between two hard, flat surfaces and under a 7 lb. weight. Store at ambient room temperature for 24 hours. Then, unwrap the labels and let them air dry. Read and record with LaserChek II scanner and verifier. The print contrast signal (PCS) bar width growth (BWG), and percent decode (% Decode) is measured with the LaserChek II scanner and verifier of Symbol Technologies.

40° C. PVC Resistance. Imaged samples are covered with at least three layers of Borden PVC film on both sides. Make sure that the film is free of wrinkles and foldovers. Place the wrapped samples between two hard, flat surfaces with 3.5 kg weight on top to ensure good contact between the plastic film and the printed label. Store in 40° C. oven for 24 hours, unwrap the labels and read with LaserChek II scanner and verifier. The print contrast signal (PCS), bar width growth (BWG) and percent decode (% Decode) is measured with the LaserChek II scanner and verifier.

Alcohol Resistance. Imaged samples are placed into 100 ml beakers that contain 20% by weight isopropyl alcohol. Each beaker is able to hold two samples. The bar code samples should not contact each other. The bar codes should be completely immersed. Retain sample in alcohol for two hours at room temperature. Then, remove samples from the alcohol and allow to air dry for 24 hours. Read and record with LaserChek II scanner and verifier. The PCS, BWG and % Decode are measured with the LaserChek II scanner and verifier of Symbol Technologies.

Oil Resistance. Imaged samples are placed on a flat surface and tamped (???) to the surface. Pour Crisco vegetable oil on paper toweling. Coat sample with a thin film of oil with toweling. Distribute oil evenly so that there are no "puddles." Store at room temperature for 24 hours. After 24 hours wipe off excess oil. Read and record with LaserChek II. The PCS, BWG and % Decode measured with the LaserChek II scanner and verifier of Symbol Technologies.

The following examples are given to illustrate some of the features of the present invention and should not be considered as limiting. In these examples all parts or proportions are by weight and all measurements are in the metric system, unless otherwise stated.

Parts

Dispersion A—Chromogenic Material
Chromogenic Material—3-Diethyamino-6-methyl-7-anilinofluoran 30.0
Binder, 20% solution of Polyvinyl alcohol in water 25.0
Defoaming and dispersing agents 0.4
Water 44.6
Dispersion B—Acidic Material
Acidic Material—Bis(4-hydroxy-3-allylphenyl)sulphone 38.0
Binder, 20% solution of Polyvinyl alcohol in water 18.0
Defoaming and dispersing agents 0.4
Water 43.6
Active Formulation 1 (21.6% filler) Parts
Dispersion A (Chromogenic) 22.0
Dispersion B (Acidic) 39.0
Binder, 50% SBR latex in water 6.0
Filler slurry, 30% Silica in water 25.0
Water 8.0
Active Formulation 2 (12.1% filler) Parts
Dispersion A (Chromogenic) 25.0
Dispersion B (Acidic) 44.0
Binder, 50% SBR latex in water 6.0
Filler slurry, 30% Silica in water 14.0
Water 11.0
Active Formulation 3 (5.2% filler) Parts
Dispersion A (Chromogenic) 27.0
Dispersion B (Acidic) 48.0
Binder, 50% SBR latex in water 6.0
Filler slurry, 30% Silica in water 6.0
Water 13.0
Coating Formulation Release 1 Parts
Silicone Emulsion, polydimethylsiloxane
(SILFORCE SM3200 Momentive Performance Materials, Albany, N.Y.) 65.6
Pt catalyst, polydimethylsiloxane
(SILFORCE SM3110 by Momentive Performance Materials, Albany, N.Y.) 21.9
Water 12.5
Total Pt concentration 206 ppm
Coating Formulation Release 2 Parts
Silicone Emulsion
(SILCOLEASE PC-105NXL, Bluestar Silicones, East Brunswick, N.J.) 64.9
Silicone X-linker emulsion
(SILCOLEASE PC-31, Bluestar Silicones, East Brunswick, N.J.) 5.7
Pt catalyst
(SILCOLEASE PC-95SP, Bluestar Silicones, East Brunswick, N.J.) 21.2
Water 8.2
Total Pt concentration 195 ppm
Coating Formulation Release 3 Parts
Silicone Emulsion (DEHESIVE 490, Wacker Chemical Corporation, Adrian, Mich.) 71.9
Silicone X-linker emulsion
(CROSSLINKER V72 by Wacker Chemical Corporation, Adrian, Mich.) 10.4
Pt catalyst
(CATALYST 454E by Wacker Chemical Corporation, Adrian, Mich.) 14.6
Water 3.1
Total Pt concentration 191 ppm
Coating Formulation Release 1B Parts
Silicone Emulsion, polydimethysiloxane
(SILFORCE SM3200 Momentive Performance Materials, Albany, N.Y.) 73.5
Pt catalyst
(SILFORCE SM3110 Momentive Performance Materials, Albany, N.Y.) 14.0
Water 12.5
Total Pt concentration 137 ppm
Coating Formulation Release 1C Parts
Silicone Emulsion
(SILFORCE SM3200 Momentive Performance Materials, Albany, N.Y.) 76.6
Pt catalyst
(SILFORCE SM3110 Momentive Performance Materials, Albany, N.Y.) 10.9
Water 12.5
Total Pt concentration 103 ppm
Coating Formulation Release 2B Parts
Silicone Emulsion
(SILCOLEASE PC-105NXL Bluestar Silicones, East Brunswick, N.J.) 72.3
Silicone X-linker emulsion
(SILCOLEASE PC-31 Bluestar Silicones, East Brunswick, N.J.) 6.4
Pt catalyst
(SILCOLEASE PC-95SP Bluestar Silicones, East Brunswick, N.J.) 12.7
Water 8.6
Total Pt concentration 117 ppm
Coating Formulation Release 2C Parts
Silicone Emulsion
(SILCOLEASE PC-105NXL Bluestar Silicones, East Brunswick, N.J.) 76.0
Silicone X-linker emulsion
(SILCOLEASE PC-31 Bluestar Silicones, East Brunswick, N.J.) 6.7
Pt catalyst
(SILCOLEASE PC-95SP Bluestar Silicones, East Brunswick, N.J.) 8.5
Water 8.8
Total Pt concentration 76 ppm
Coating Formulation Release 3B Parts
Silicone Emulsion
(DEHESIVE 490 Wacker Chemical Corporation, Adrian, Mich.) 77.2
Silicone X-linker emulsion
(CROSSLINKER V72 Wacker Chemical Corporation, Adrian, Mich.) 11.2
Pt catalyst
(CATALYST 454E Wacker Chemical Corporation, Adrian, Mich.) 8.7
Water 2.9
Total Pt concentration 115 ppm
Coating Formulation 3C Parts
Silicone Emulsion
(DEHESIVE 490 Wacker Chemical Corporation, Adrian, Mich.) 78.0
Silicone X-linker emulsion
(CROSSLINKER V72 Wacker Chemical Corporation, Adrian, Mich.) 11.4
Pt catalyst
(CATALYST 454E Wacker Chemical Corporation Adrian, Mich.) 7.8
Water 2.8
Total Pt concentration 102 ppm
Coating Formulation Release 4 Parts
Silicone Emulsion
(X-52-195 Shin-Etsu Chemical Co., Ltd., Tokyo, Japan) 100
Pt catalyst
(CAT-PM-10A Shin-Etsu Chemical Co., Ltd. Tokyo, Japan) 5
Water 3
Coating Formulation Release 5 Parts
Silicone Polymer
(SILFORCE UV9400 Momentive Performance Materials, Albany, N.Y.) 98.0
Photocatalyst
(SILFORCE UV9390C Momentive Performance Materials, Albany, N.Y.) 2.0

Example 1

A linerless direct thermal label was prepared by forming a layer of Release 1 at a ctwt of 1.4 g/m2. This coating was applied to a sheet having Active 3 already applied at 2.0 g/m2.

Example 2

A linerless direct thermal label was prepared in a similar way to Example 1, except Release 1 was replaced with Release 2.

Example 3

A linerless direct thermal label was prepared in a similar way to Example 1, except Release 1 was replaced with Release 3.

Example 4

A linerless direct thermal label was prepared in a similar way to Example 1, except Release 1 was replaced with Release 1B.

Example 5

A linerless direct thermal label was prepared in a similar way to Example 1, except Release 1 was replaced with Release 1C.

Example 6

A linerless direct thermal label was prepared in a similar way to Example 1, except Release 1 was replaced with Release 2B.

Example 7

A linerless direct thermal label was prepared in a similar way to Example 1, except Release 1 was replaced with Release 2C.

Example 8

A linerless direct thermal label was prepared in a similar way to Example 1, except Release 1 was replaced with Release 3B.

Example 9

A linerless direct thermal label was prepared in a similar way to Example 1, except Release 1 was replaced with Release 3C.

Example 10

A linerless direct thermal label was prepared in a similar way to Example 1, except Release 1 was replaced with Release 4.

The samples were upon coating, tested for rapid cure. Samples were placed into dry oven at 80° C. for 20 seconds. The results are in Table 1 using the following criteria.

PASS: coating layer was sound and was not able to be abraded or smeared by touch FAIL: coating abraded and or smeared to the touch

TABLE 1

| | 80° C. for 20 seconds |
|---|---|
| Example 1 | PASS |
| Example 2 | PASS |
| Example 3 | PASS |
| Example 4 | FAIL |
| Example 5 | FAIL |
| Example 6 | FAIL |
| Example 7 | FAIL |
| Example 8 | FAIL |
| Example 9 | FAIL |
| Example 10 | FAIL |

The samples that formed a sound coating layer were then coated on thermal imaging layer with differing levels of filler to evaluate the effect on release and coating adhesion.

Example 11

A linerless direct thermal label was prepared in a similar way to Example 1, except Active 3 was replaced with Active 2.

Example 12

A linerless direct thermal label was prepared in a similar way to Example 1, except Active 3 was replaced with Active 1.

Example 13

A linerless direct thermal label was prepared in a similar way to Example 2, except Active 3 was replaced with Active 2.

Example 14

A linerless direct thermal label was prepared in a similar way to Example 2, except Active 3 was replaced with Active 1.

Example 15

A linerless direct thermal label was prepared in a similar way to Example 3, except Active 3 was replaced with Active 2.

Example 16

A linerless direct thermal label was prepared in a similar way to Example 3, except Active 3 was replaced with Active 1.

After curing, the samples were tested for release by using 3M 810 tape.

Samples were placed with 5 lb (2.26 kg) weight @ 23° C. and 40° C. for 1 week.

Peel was tested using TMI Labmaster 80-91 at 90 deg and 600 ipm (15.24 meters per minute).

PASS: <50 N/m and peeling was performed with slight resistance but no practical problem FAIL: >50 N/m and peeling was performed with severe resistance and/or the label was torn.

Samples were also tested for adhesion of the release layer by testing for scuff resistance while traveling over the printhead during printing, as buildup on the printhead is an indicator of poor adhesion. Samples were printed on a ITHACA 9000 printer after 1000 consecutive prints.

PASS: amount of printhead buildup did not noticeably affect print quality

FAIL: amount of printhead buildup that affects print quality

The results are included in Table 2.

| | Initial peel | 1 week peel | Residue |
|---|---|---|---|
| Example 1 | Fail | Fail | Pass |
| Example 2 | Fail | Fail | Pass |
| Example 3 | Fail | Fail | Pass |
| Example 11 | Pass | Pass | Pass |
| Example 12 | Pass | Pass | Fail |
| Example 13 | Pass | Pass | Pass |
| Example 14 | Pass | Pass | Fail |
| Example 15 | Pass | Pass | Pass |
| Example 16 | Pass | Pass | Fail |
| Example 12 | Pass | Pass | Fail |

Example 17

A linerless direct thermal label was prepared in a similar way to Example 1, except Release 1 was replaced with Release 5. The example was cure @ 200 Watt (w) UV lamp @ 150 fpm (45.72 meters per minute).

Example 18

A linerless direct thermal label was prepared in a similar way to Example 13, except a PVOH mid layer was applied @ 1.0 g/m2.

Samples of the preferred example was compared to the alternative release technology commonly used, UV. The compatibility of a water based addition release formula with the imaging layer is seen in the table 3 by measuring the background before and after application of release coating.

Background was measured by using the Gretag D19C.

PASS: <0.1 unit change. No noticeable background change to the human eye.

FAIL: >0.1 unit change. Noticeable background change/darkening.

TABLE 3

| Sample | Initial | Final | Change | Rating |
|---|---|---|---|---|
| Example 1 | 0.07 | 0.09 | 0.02 | Pass |
| Example 2 | 0.07 | 0.10 | 0.03 | Pass |
| Example 3 | 0.07 | 0.08 | 0.01 | Pass |
| Example 17 | 0.07 | 0.27 | 0.20 | Fail |
| Example 18 | 0.07 | 0.08 | 0.01 | Pass |

Standard UV release coatings can benefit from a barrier layer to achieve better background levels. The aqueous release coat of the invention surprisingly can be applied as an overcoat layer in direct contact with the heat sensitive coating.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Uses of singular terms such as "a," "an," are intended to cover both the singular and the plural, unless otherwise indicated herein or clearly contradicted by context. The terms "comprising," "having," "including," and "containing" are to be construed as open-ended terms. All references, including publications, patent applications, and patents, cited herein are hereby incorporated by reference. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims.

What is claimed is:

1. An improved thermally responsive record material useful for linerless labels, the record material comprising a substrate having first and second surfaces and having provided thereon on at least a first surface:

a heat sensitive coating comprising in one or more layers a substantially colorless dye precursor and an acidic developer material in substantially contiguous relationship; and including in addition;

a release coating over the heat sensitive coating and in direct contact with the heat sensitive coating, the release coating comprising an aqueous mixture of a water soluble or water dispersible polymeric material, a release agent and an excess of platinum catalyst, 191 or greater ppm; and, based on weight of the release coating, a binder material;

wherein the heat sensitive coating upon being heated reacts with the dye precursor to develop color;

wherein the release coating is cured at temperature at or below 160° C. without visible background discoloration of the heat sensitive coating.

2. The thermally responsive record material according to claim 1 wherein the polysiloxane release agent provides scuff resistance for the record material.

3. The thermally responsive record material according to claim 1 including in addition an adhesive layer on a second surface of the substrate.

4. The thermally responsive record material according to claim 1 wherein the polysiloxane release agent is cured by heat or actinic radiation.

5. The thermally responsive record material according to claim 1 wherein in the release coating, the platinum catalyst comprises a platinum catalyst selected from metallic platinum, a platinum salt, and an organic platinum compound.

6. The thermally responsive record material according to claim 5 wherein the platinum catalyst has an oxidation state from 0 to IV.

7. The thermally responsive record material according to claim 6 wherein the platinum catalyst comprises a platinum catalyst selected from the group consisting of chloroplatinic acid and olefin complexes, platinum (0) complexes containing vinyl-siloxane ligands, platinum (II) chloride, salts of chloroplatinic acid, tetrachloroplatinic acid, platinum (IV) chloride, hexachloroplatinic acid, hexachloroplatinic acid ammonium salt, platinum (II) oxide, platinum (II) hydroxide, platinum (IV) dioxide, platinum (IV) oxide, platinum (IV) disulfide, platinum (IV) sulfide, potassium hexachloroplatinate (IV), dichloro(cycloocta-1,5-diene) platinum (II), and ammonium salts of chloroplatinic acid.

8. The thermally responsive record material according to claim 1 wherein one or more coatings comprise in addition from 6-50% by weight oil absorptive pigment based on weight of the coatings.

9. The thermally responsive record material according to claim 1 wherein the heat sensitive coating includes in addition 6-50% by weight oil absorptive pigment.

10. The thermally responsive record material according to claim 1 wherein the release coating is applied at the rate of 1 to 6 grams per square meter (gsm).

11. The thermally responsive record material according to claim 1 wherein the release agent is a polysiloxane or silicone material.

12. A method of providing an improved thermally responsive record material useful for linerless labels, the record material comprising a support having provided thereon on one surface an adhesive material, and on at least one other surface, a heat sensitive imaging coating, the method comprising:

applying to a first surface a first layer of a coating of a heat sensitive color-forming composition comprising a binder material and a substantially colorless dye precursor and an acidic developer material in substantially contiguous relationship;

applying over the first layer, a second layer overcoating the first layer and in direct contact with the heat sensitive coating, the second layer comprising a water soluble or water dispersible polymeric material, a release agent and an excess of platinum catalyst, 191 ppm or greater, based on weight of the second layer; and curing the second layer at a temperature at or below 160° C. without visible background discoloration of the first layer.

13. The method of providing a thermally responsive record material according to claim 12 wherein in the second layer the platinum catalyst is selected to have an oxidation state from 0 to IV.

14. The method of providing a thermally responsive record material according to claim 12 wherein in the second layer the platinum catalyst is selected from the group consisting of metallic platinum, a platinum salt and an organic platinum compound.

15. The method of providing a thermally responsive record material according to claim 12 wherein the platinum catalyst comprises a platinum catalyst selected from the group consisting of chloroplatinic acid and olefin complexes, platinum (0) complexes containing vinyl-siloxane ligands, platinum (II) chloride, salts of chloroplatinic acid, tetrachloroplatinic acid, platinum (IV) chloride, hexachloroplatinic acid, hexachloroplatinic acid ammonium salt, platinum (II) oxide, platinum (II) hydroxide, platinum (IV) dioxide, platinum (IV) oxide, platinum (IV) disulfide, platinum (IV) sulfide, potassium hexachloroplatinate (IV), dichloro(cycloocta-1,5-diene) platinum (II), and ammonium salts of chloroplatinic acid.

16. The method of providing a thermally responsive record material according to claim 12 wherein one or more of the layers include in addition 6-50% by weight oil absorptive pigment.

17. The method of providing a thermally responsive record material according to claim 12 wherein the second layer is applied at the rate of 1 to 6 gsm.

18. The method of providing a thermally responsive record material according to claim 12 wherein the second layer is cured to a hardness which resists scuffing.

19. The method of providing a thermally responsive record material according to claim 12 wherein curing of the second layer is at a temperature of from 70° C. to 120° C.

* * * * *